United States Patent [19]

Gelman

[11] Patent Number: 5,018,289

[45] Date of Patent: May 28, 1991

[54] CHANGEABLE SIGN DISPLAY DEVICE WITH IMPROVED PANEL SUSPENSION

[75] Inventor: Gideon Gelman, Petah, Israel

[73] Assignee: Product Innovations, Skokie, Ill.

[21] Appl. No.: 192,145

[22] Filed: May 10, 1988

[51] Int. Cl.[5] ..... G09F 11/12

[52] U.S. Cl. ..... 40/472

[58] Field of Search ..... 40/472, 512, 524, 594

[56] References Cited

U.S. PATENT DOCUMENTS

| | | | |
|---|---|---|---|
| 666,727 | 1/1901 | Wright | 40/472 |
| 2,033,130 | 3/1936 | Eitzen | 40/472 |
| 2,060,341 | 11/1936 | O'Shea et al. | 40/472 |
| 2,363,725 | 11/1944 | Graham | 40/472 |
| 2,585,687 | 2/1952 | Sanderson | 74/436 |
| 2,734,295 | 2/1956 | Fewster et al. | 40/472 |
| 2,867,050 | 1/1959 | Westfall | 40/472 |
| 3,384,986 | 5/1968 | Davis | 40/546 |
| 3,824,721 | 7/1974 | Burns | 40/472 |
| 3,965,593 | 6/1976 | Harruff | 40/446 |
| 4,005,535 | 2/1977 | Davis | 40/471 |
| 4,652,239 | 3/1987 | Brimberg | 40/594 |

FOREIGN PATENT DOCUMENTS

| | | | |
|---|---|---|---|
| 43242 | 10/1930 | Denmark | 40/472 |
| 214587 | 3/1987 | European Pat. Off. | 40/524 |
| 328366 | 5/1930 | United Kingdom | 40/472 |
| 1096567 | 12/1967 | United Kingdom | 40/472 |

OTHER PUBLICATIONS

Rexnord catalog sheet, entitled "Roller Chains with , K' Attachments".

*Primary Examiner*—Cary E. Stone

*Attorney, Agent, or Firm*—Ronald P. Kananen

[57] ABSTRACT

An improved display device, which includes an enclosure having first and second opposing planar sections each having at least one opening formed therein. A plurality of elongated spools are mounted inside the enclosure, a first pair of the spools being disposed at opposing each of the first planar section and aligned along a plane parallel to the plane of the first planar section, a second pair of the spools being disposed at opposing ends of the second planar section and aligned along a plane parallel to the plane of the second planar section. The spools have upper and lower belt engaging devices. A motor is operatively connected to at least one of the spools. Upper and lower endless belts operatively engage the belt engaging devices and sequentially connect the plurality of spools, effecting simultaneous rotation thereof. A plurality of panels of visual display material are yieldably connected to the endless belts along a pair of opposed edge portions of each of the panels and disposed to permit the viewing of at least one of the panels through each of the openings in the planar sections.

9 Claims, 3 Drawing Sheets

CHANGEABLE SIGN DISPLAY DEVICE WITH IMPROVED PANEL SUSPENSION

BACKGROUND OF THE INVENTION

This invention relates to an improved changeable sign display device in which each of a plurality of panels of visual display material is sequentially displayed in a frame-like opening on one or more sides of the display device for pre-determined time intervals. More particularly, this invention relates to a display device having a spaced pair of endless roller chains threaded about a plurality of driver and idler rollers in the device with resilient means for conveniently suspending the display panels on a web mounted between the roller chains. Still more particularly, this invention relates to a one-sided or two-sided display device wherein flexible display panels are mounted on a web which is resiliently mounted between hinges on a spaced pair of endless roller chains threaded along a path through the device defined by driver and idler rollers to sequentially display the panels for predetermined time intervals.

The prior art has developed a number of devices for displaying panels containing messages or advertising. A billboard is a well-known example which suffers from the problem of readily and easily changing the display. Such devices have significant shortcomings in that changing the display panel is costly and inconvenient, and the same panel is thus continuously displayed for long periods of time.

Prior art display devices have employed various designs in order to produce a display device which can automatically change the display periodically. Such devices have included a flexible web for mounting the panel. However, the friction drive means employed in some prior art devices to advance the display panels tended to slip, causing the display to deframe, and the mounting of the flexible web tended to cause tearing and other disintegration of the web and the display panels which limited the size of the webs and panels and the useful lifetime of display material used in those devices. In addition, variations in the size of the panels of display material, which occurred due to age, temperature variation and other causes, resulted in inexact positioning and looseness in the display material which contributed to destruction of the display material and degradation in the visual quality of the display. Thus, in the prior art devices, the size of the display material was limited, the useful life of the display material was limited, and the visual quality of the display would severely degrade during extensive use.

An example of a serpentine-wound endless belt for continuously advancing a moving message in a two-sided display device is found in U.S. Pat. No. 2,867,050. In that device, a panel is slidably mounted for movement in a channel for receiving a projected image from an endless belt driven by perforations. Other devices showing a progressively revealed multi-sided display are found in U.S. Pat. No. 4,005,535 and 2,585,687.

Such devices have proved unsatisfactory for several reasons. For example, a friction belt when subjected to multiple starts and stops when indexing a display will tend to slip slightly causing a successively worsening deframing of the display. Moreover, it is difficult and inconvenient to replace the display panels in such displays.

Accordingly, it is a general problem in this art to provide a display device of the type described which includes a positive drive mechanism with a convenient means for changing panels in a sequential display device.

SUMMARY OF THE INVENTION

It is therefore a general object of the present invention to provide an improved changeable sign display device which overcomes the aforementioned problems of the prior art display devices.

It is another general object of this invention to provide a positively driven panel in a one or two-sided display device with means for tensioning the panel.

More particularly, it is an object of the invention to provide, in another embodiment, a two-sided changeable sign display device in which each of a series of panels of visual display material is sequentially displayed on each side of the sign for a predetermined length of time.

It is a further object of the invention to provide a display device which allows for the use of large panels of visual display materials without tearing them or otherwise causing their disintegration during extended use by providing a convenient, resiliently-biased hanger for mounting the panels on a roller chain.

Another object is to provide a device which maintains the panels of visual display material taut and in a planar configuration so that the visual quality of the display, whether one or two-sided, is maintained despite variations in the size of the panel material which may be caused by age, temperature, humidity and the like.

Further objects and advantages of the invention will become apparent upon reading the following detailed description and appended claims, and upon reference to the accompanying drawings.

These objects are achieved by an improved display device of the invention, which, in a two-sided embodiment, includes an enclosure having first and second opposing planar sections, with each of the planar sections having at least one opening for framing a display panel transported within the device. A plurality of elongated spools are mounted inside the enclosure, a first pair of the spools being disposed at opposing ends of the first planar section and aligned along a plane parallel to the plane of the first planar section, a second pair of the spools being disposed at opposing ends of the second planar section and aligned along a plane parallel to the plane of the second planar section. The spools have upper and lower roller chain engaging means for a two-sided billboard sign. For a single-sided billboard, the spools include left and right roller chains. A motor is operatively connected to at least one of the spools. The upper and lower roller, or left and right chains, operatively engage the chain engaging means and sequentially connect the plurality of spools, effecting simultaneous rotation thereof. A plurality of panels of visual display material are yieldably connected to the roller chains along a pair of opposed edge portions of each of the panels and disposed to permit the viewing of at least one of the panels through each of the framed openings in each of the opposed planar sections. The panels are spaced along the roller chains at a distance not less than the sum of the distance between the centers of the one of the first pair of spools disposed at one end of a planar section and the corresponding spool at the other end of the planar section plus one half the circumference of the belt engaging means. For a single-sided display device, the panels may be located adjacent to each other. Optionally, the device may also have a timer which cooperates with the motor, intermittently actuating the motor for a predetermined duration at predetermined intervals to successively index the panels so that two panels are accurately framed on each of the opposed sides of the device. The device may also have a light source within the enclosure, positioned so as to enhance the visual display.

These and other features of the invention will become apparent from the written description which follows, taken with the accompanying drawings.

BRIEF DESCRIPTION OF THE DRAWINGS

For a more complete understanding of the invention, reference should now be made to the embodiments illustrated in greater detail in the accompanying drawings, wherein.

DETAILED DESCRIPTION OF THE DRAWINGS INCLUDING PREFERRED EMBODIMENTS

Figure 1:
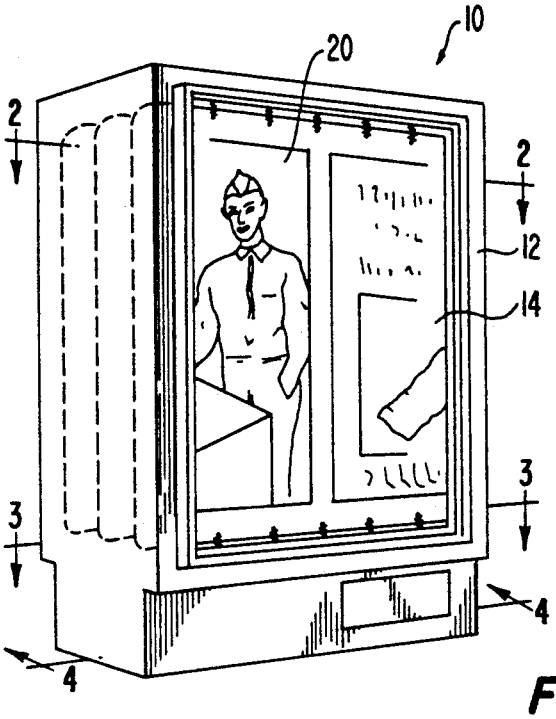
FIG. 1 is a perspective of a two-sided display device according to the invention.

As shown in FIG. 1, the display device has a box-like enclosure 10 having at least one planar section 12 for framing a display panel. The planar section 12 has at least one opening 14 which forms the display area through which one of the panels of display material 20 is framed and thus visible. In a preferred embodiment, the device displays panels on each of two opposed sides and thus has two opposing planar sections 12 and 13 which are spaced apart from one another. Each of the two planar sections has at least one opening 14, 15 formed therein for framing the respective displays. The enclosure 10 has opposed solid sides connecting the sections 12, 13 in a manner sufficient to provide a complete rectangular enclosure. The panels of display material 20, such as posters, are thus hidden within the enclosure except to the extent each is respectively sequentially visible through the opening 14 in a section 12, or through the opening 15 in a section 13.

Figure 2:
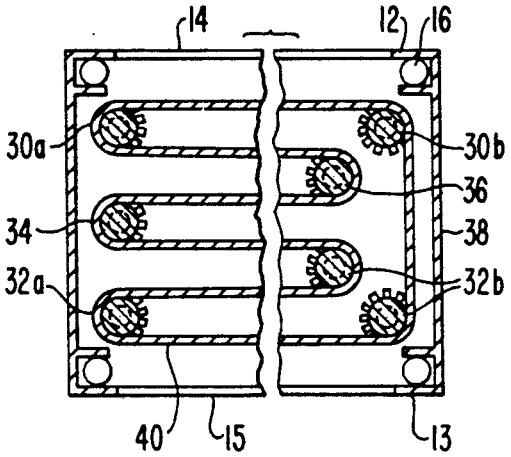
FIG. 2 is an upper horizontal sectional view of the two-sided display device taken generally along line 2—2 of FIG. 1.
Figure 3:
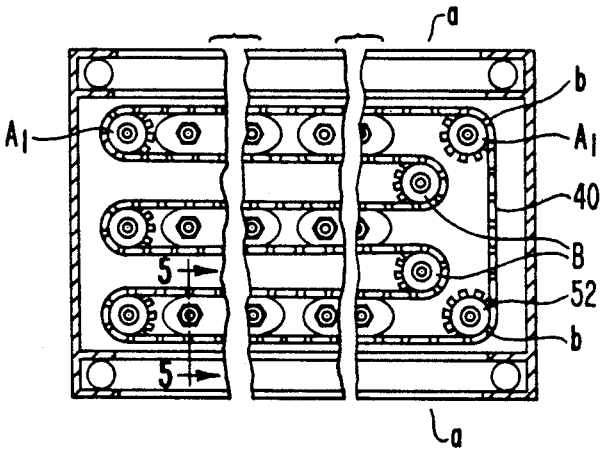
FIG. 3 is a lower horizontal sectional view taken generally along line 3—3 of FIG. 1 showing the lower roller chain in the preferred embodiment.

As seen in FIGS. 2 and 3, a plurality of elongated spools are mounted inside the enclosure for intermittently guiding a web through the device to frame the display material 20 in each of the opposed openings 14, 15. While an endless web is preferred, a plurality of connected web portions with displays attached are suitable. Each of the spools has an upper and lower chain engaging member which has a cross-section which is substantially circular and which positively engages a drive chain. A roller chain 40 is operatively engaged with the chain engaging member. The roller chain 40 thus sequentially connects the plurality of spools, effecting simultaneous rotation of the idler spools with the driven spool or spools.

In a device which displays panels for two opposed sides (i.e. a "two-sided device"), the spools are positioned within the enclosure 10 so that one pair of spools **30*a* and 30*b* is disposed at opposing ends of one of the planar display sections 12 and aligned in a plane parallel to the plane of that planar section. Another pair of spools 32*a* and 32*b* is similarly disposed at opposing ends of the other planar section 12** and aligned in a plane parallel to that planar section.

In the embodiment shown, three additional spools 34, 36 and 38 are positioned to provide three complete direction reversals of the endless chain. Each reversal provides a space for two panels to display material. Thus, the seven spool, three reversal arrangement shown allows a framed display of six panels of visual display material.

Figure 4:
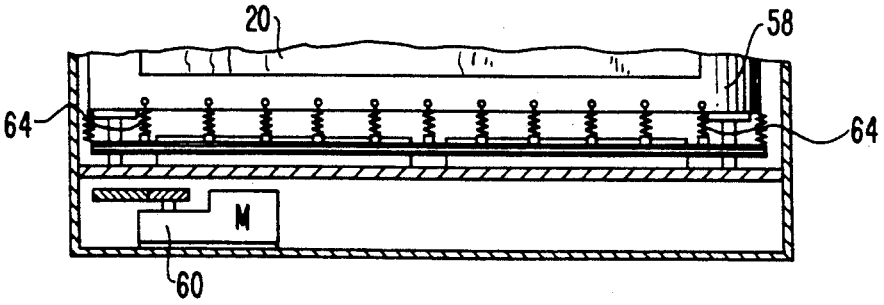
FIG. 4 is a partial front sectional view of the lower portion of the display device taken generally along line 4—4 of FIG. 1 illustrating the detail of a resiliently-biased hanger connection for securing the roller to an endless web or to a web portion for mounting the panels of display material.
Figure 11:
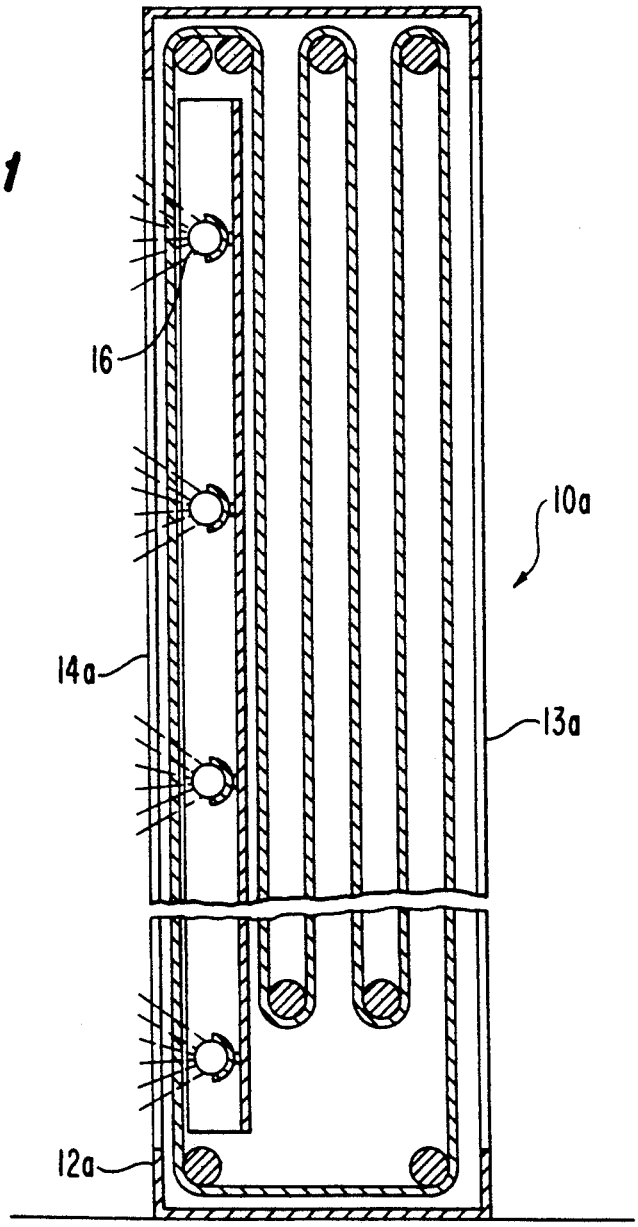
FIG. 11 is a vertical or horizontal cross-sectional view of a single-sided display device, with exemplary back lighting.

The panels of visual display material, such as a plurality of posters 20, can be mounted or framed on a continuous web 58 as seen in FIGS. 1 and 4, or on one of a plurality of interconnected segments. The continuous web 58, which may be made of various resilient materials, including, for example, canvas, is yieldably connected by connecting means such as springs or flexible material 64 to the roller chain 40 along a pair of opposed edge portions of the web shown in FIG. 3. While FIGS. 2 and 3 show the panel as lighted from the front by lights 16, the panel can be transparent or translucent and lighted from its rear side, as shown in FIG. 11. The posters 20 are spaced along the endless web such that at least one of the panels of display material is framed and visible through the openings 14, 15 in the planar sections 12, 13. In order to properly position the panels of display material along the endless web, it is necessary to fix the positioning of the spools. The distance between respectively displayed panels must be not less than the sum of the distance between the centers of one of the spools disposed at one end of the planar section and the corresponding spool disposed at the same end of the other planar section plus one-half the circumference of the belt engaging means. This relationship controls the displaying of the two respective entire panels at the planar sections 14. Thus, referring to FIG. 2, the distance between the centers of the spools **30*a* and 32*a* is measured. The circumference of the chain engaging means is also known. The sum of the distance from 30*a* to 32*a*** plus one-half of the circumference is thus the minimum distance between the panels.

Guide members (not shown) may be used in the embodiments of FIGS. 2 and 3, for example, to direct the web 50 along its serpentine path through the device.

Such a guide member may take to form of an arcuate plate having an appropriate curvature to direct the web through turns such as about each of the rollers 30*a*, 30*b*, 32*a*, 32*b*, 34 and 36. The use of such guide members, spaced outwardly from the outer periphery of the rollers, will aid in preventing the web section from stacking with one another when turning about the spindles by bending the web sections appropriately.

The term "roller chain" as used herein is not meant to imply any particular form or construction of the chain. Many different constructions of the chain are possible, and one skilled in the art will readily realize the adaptability of many different materials such as rubber, plastic or metal in a variety of possible forms such as belts, tracks or chain which positively engage the spools without slippage. An example is a timing belt. It is also possible that the first and second roller chains could be made of differing construction. The chain engaging means can also be of various construction, so long as the means are adapted to work with whatever given chain construction that is used. Thus, for instance, as shown in FIG. 3 in the preferred embodiment, the roller chain is a linked drive chain 50 and the chain engaging means are sprockets 52 adapted to drive such a chain. Such devices and sprockets are well known in the art and are available in various sizes for precise engagement under American and European standards. Such chains are available from Rexnord, for example.

The yieldable connection between the web 50 and the roller chain 40 provided by the springs or flexible material 64 allows the web 58 and posters 20 to flex when the posters and web are driven by the roller chain around a spool 30. Force is provided by a driving means such as motor 60 to at least one spool 30 and thus to the endless belts. Preferably, the motor drives a pair of rolls 36, 38 through a geared chain link arrangement shown in FIG. 2 and in FIG. 4 to distribute the tensions along the belt 40. Thus, the panels of visual display material are not directly subjected to frictional drive forces.

Figure 5:
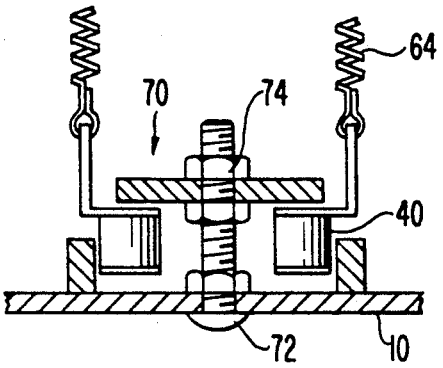
FIG. 5 is a partial sectional view taken along line 5—5 of FIG. 3 of a keeper member for retaining the roller chain in place.

Because the springs 64 exert force on both the endless belt 40 and the web 58 it is preferable to provide keeper members so that the roller chain remains operatively engaged with the belt engaging means on the spools and so that movement of the chain relative to its sprocket is inhibited. In this way, the roller chain is held in position and the web is kept taut and in the proper planar configuration. These keeper members 70 are seen in a top view in FIG. 3. FIG. 5 is a sectional view of a keeper member taken along line 5—5 of FIG. 3. It shows the keeper member in the embodiment where the roller chain 40 is a linked drive chain. The keeper member is an elongated member, adjustably secured, which allows the drive chain to pass beneath it while moving horizontally without moving vertically or laterally. The keeper member is secured to the enclosure 10, by securing means such as bolt 72 and nut 74.

Figure 6:
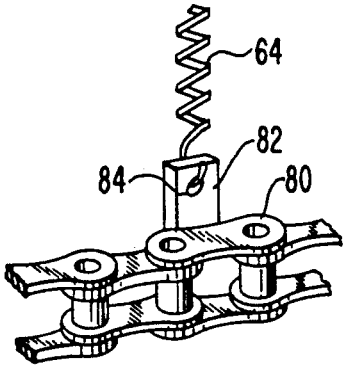
FIG. 6 is a detailed view showing the connection of a biasing spring to a hanger on the roller chain.

FIG. 6 shows a construction of one link in the linked drive chain which is the preferred roller chain which allows for a connection with a spring 64. This connection link 80 provides a tongue 82 with hole 84 therein which allows for connection of the springs 64 to the web. The tongue 84 is positioned to one side of the link so that, when operative, the drive chain can pass the keeper member 70 and turn about the sprockets. This connector link is incorporated at the proper places in the drive chain to allow springs 64 to connect the drive chain 50 to the web 58. For a Rexnord roller chain as described above, such links are called "K attachments" and a link with an attachment is available as a unit for spaced positioning in the roller chain.

Figure 8:
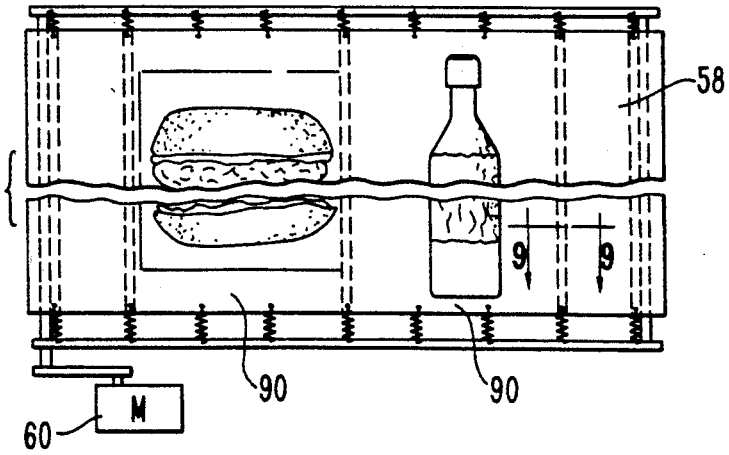
FIG. 8 is a view of the horizontally-driven endless web with supporting bars and its connection to the roller chain.
Figure 9:
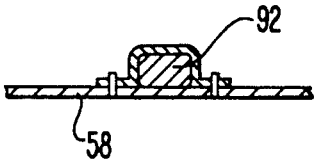
FIG. 9 is a section view taken along line 9—9 of FIG. 8 of a web portion with a supporting bar.
Figure 10:
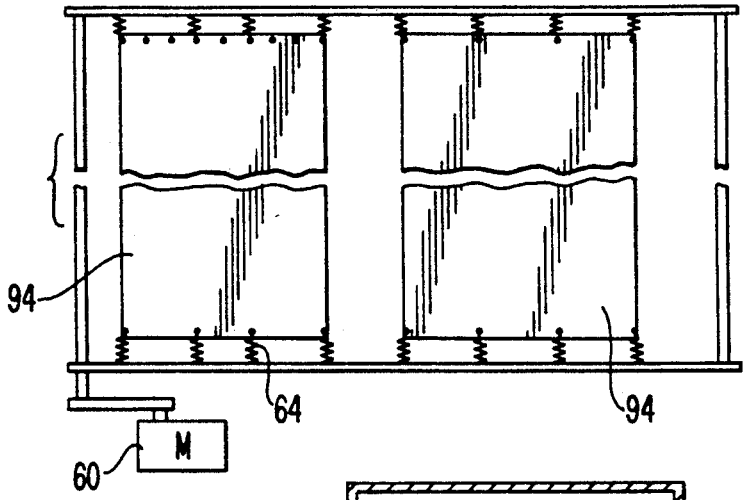
FIG. 10 is a schematic view of connections for separate panels of display material to web portions of the endless belts.

As previously disclosed, the panels of display material are yieldably connected to the roller chains. This may be accomplished directly or indirectly. Thus, the panels of visual display material can be formed on a continuous web or the panels of display material may be formed on, or affixed to, the continuous web, which is, in turn connected to the endless belts. FIG. 8 shows one embodiment wherein the web 58 has pockets 90 formed therein which are adapted to receive supporting bars 92 therein. FIG. 9 shows a section of the web 58 with a pocket 90 formed therein. A supporting bar 92 is located in the pocket 90. Alternatively, the panels of display material may be formed on separate frames 94 which can be connected to the roller chain by springs 64 or other means as in FIG. 10. Alternatively, the panels may be temporarily adhesively secured to the endless panel by easily removable adhesive.

Optionally, a timer cooperates with the driving means, intermittently actuating the driving means for a predetermined duration at predetermined intervals. Thus, the particular panels which are visible through the framed openings, are changed at predetermined intervals so that other panels not visible through the enclosure are then visible. These panels remain visible for a predetermined amount of time and then are replaced by other panels in turn.

If desired, a light source 16 (shown in FIGS. 2 and 11) can be accommodated within the enclosure 10 in such a manner as to enhance the viewability either directly or by backlighting in the of the display as seen in FIG. 2, or by the lighting arrangement shown in the single-sided embodiment of FIG. 11, which could be used to illuminate both display panels in a two-sided embodiment.

Figure 7:
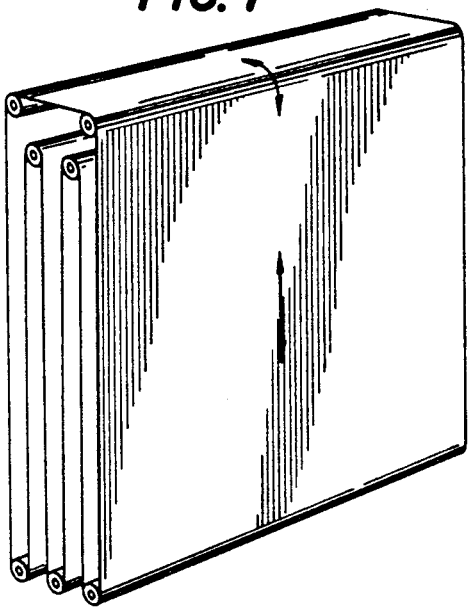
FIG. 7 is a schematic view of the endless web and spools for traversing the framed display vertically rather than horizontally.

In an alternate embodiment, as shown in FIG. 11 the objects of this invention are achieved by a one-sided changeable sign display device 10*a* which has a single planar section 12*a* having at least one framed opening 14*a* formed therein. This embodiment is suitable for use where a two-sided sign would not be useful, such as where it is desired for the sign to be connected along one side 13*a* to a wall or other opaque surface. The operation of the single-sided device is similar to that in the two-sided embodiment. However, in the single-sided embodiment, the visual display material can be moved by the roller chain in either a horizontal path as described above or in a vertical path as shown in FIG. 7. Thus, FIG. 11 shows the principle of operation for either a horizontal pass or a vertical pass in a single-sided embodiment. In the two-sided version, however, horizontal movement of the material is required in order to keep the display material properly oriented in both display areas.

Returning to FIGS. 2 and 3, for a two-sided display, assume that the poster size is represented by the reference letter and is thus seen from either opposed side of the device 10. The reference letter thus represents the tail that is needed about a portion of the circumferences of each corner spool to position the posters correctly at the opposed sides of the device. Thus, each poster length is a+b. Six sections are suitable for this embodiment; thus the total chain length is 6(a+b). The distance between the spindles A is thus larger than the poster size, and depends on the positioning of the spindles B.

It will clearly be understood by those skilled in the art that the foregoing description has been made in terms of the preferred embodiments and various changes and modifications may be made without departing from the scope of the present invention which is to be defined by the appended claims.

What is claimed:

1. A display device comprising:

an enclosure having first and second opposing planar sections, each of the planar sections having at least one opening formed therein;

a plurality of elongated spools mounted inside the enclosure, a first pair of spools being disposed at opposing ends of the first planar section and aligned along a plane parallel to the plane of the first planar section, a second pair of spools being disposed at opposing ends of the second planar section and aligned along a plane parallel to the plane of the second planar section, the spools having upper and lower belt engaging means;

driving means operatively connected to at least one of the spools;

upper and lower endless belts positively and operatively respectively engaging the upper and lower belt engaging means and sequentially connecting the plurality of spools for effecting simultaneous rotation thereof;

a plurality of panels of visual display material;

means for yieldably connecting the plurality of panels of visual display material to the endless belts, the panels being yieldably connected to the endless belts along a pair of opposed edge portions of each of the panels and disposed to permit the viewing of at least one of the panels through the openings in the planar sections;

means for keeping the endless belts operatively engaged with said belt engaging means of said spools, said keeping means comprising elongated keeper members secured to said enclosures, said keeper members being positioned between the endless belts and the panels of visual display material.

2. The display device of claim 1 further comprising timing means cooperating with the driving means for intermittently actuating the driving means for a predetermined duration at predetermined intervals.

3. The display device of claim 1 further comprising a light source accommodated within the enclosure.

4. The display device of claim 1 wherein the yieldable connecting means comprises a plurality of springs extending between the edge portions of the panels of visual display material and the endless belts.

5. The display device of claim 1 wherein the upper and lower endless belts are linked drive chains and the upper and lower belt engaging means are sprockets adapted for engaging such chains.

6. The display device of claim 1 wherein the panels of visual display material are formed on a continuous web.

7. The display device of claim 6 wherein the continuous web has formed therein a plurality of elongated pockets oriented substantially perpendicularly to the endless belts for accommodating a plurality of reinforcing means.

8. The display device according to claim 1, wherein the elongated keeper members are adjustably secured to the enclosure.

9. The display device according to claim 1, wherein a portion of each of the endless belts extends between each two adjacent spools, and each of said elongated keeper members is positioned between the panels and two portions of one of the endless belts.

* * * * *